US012404073B2

(12) United States Patent
Davis et al.

(10) Patent No.: US 12,404,073 B2
(45) Date of Patent: Sep. 2, 2025

(54) SCENT INDICATORS ON CONTAINERS

(71) Applicants: Barry Davis, Auburn, AL (US); Ansley Dunning, Auburn, AL (US)

(72) Inventors: Barry Davis, Auburn, AL (US); Ansley Dunning, Auburn, AL (US)

( * ) Notice: Subject to any disclaimer, the term of this patent is extended or adjusted under 35 U.S.C. 154(b) by 0 days.

(21) Appl. No.: 17/809,349

(22) Filed: Jun. 28, 2022

(65) Prior Publication Data

US 2023/0415959 A1 Dec. 28, 2023

(51) Int. Cl.

| | |
|---|---|
| ***B65D 23/14*** | (2006.01) |
| ***A45D 34/00*** | (2006.01) |
| ***B65D 25/20*** | (2006.01) |
| ***B65D 75/54*** | (2006.01) |
| ***B65D 75/58*** | (2006.01) |

(52) U.S. Cl.

CPC ..... *B65D 23/14* (2013.01); *A45D 34/00* (2013.01); *B65D 25/205* (2013.01); *B65D 75/54* (2013.01); *B65D 75/5805* (2013.01); *A45D 2034/002* (2013.01)

(58) Field of Classification Search

CPC .. B65D 23/14; B65D 2203/02; B65D 23/085; B65D 33/004; B65D 25/205; B65D 23/12; B65D 77/2032; B65D 75/5855; A45D 40/0087; A45D 34/00; A45D 34/02; A45D 40/00; A45D 2200/1036

USPC ..... 206/459.5, 730, 731, 732

See application file for complete search history.

(56) References Cited

U.S. PATENT DOCUMENTS 4,117,946 A * 10/1978 Kessler ..... B65D 43/0212 220/784
4,228,954 A * 10/1980 Rosenzweig ..... B32B 5/26 239/57
4,277,024 A * 7/1981 Spector ..... A61L 9/12 206/466
4,558,783 A * 12/1985 Dangerfield ..... B65D 73/0085 206/472
4,858,758 A * 8/1989 Mitchell ..... B65D 51/28 510/439
4,925,029 A * 5/1990 Friedman ..... A45D 34/00 206/581
4,960,240 A * 10/1990 McElfresh ..... A61L 9/12 239/57
5,163,616 A * 11/1992 Bernarducci ..... A61L 9/12 239/35
5,249,676 A * 10/1993 Ashcraft ..... B65D 85/10 428/905
5,330,056 A * 7/1994 de la Rocha ..... B65D 5/5088 206/229
5,337,897 A * 8/1994 Yablans ..... B65D 83/0858 206/823
5,391,420 A * 2/1995 Bootman ..... G09F 5/04 424/76.4
5,535,885 A * 7/1996 Daniel ..... A45D 40/0087 383/107

(Continued)

*Primary Examiner* — Steven A. Reynolds
*Assistant Examiner* — Prince Pal
(74) *Attorney, Agent, or Firm* — A. J. Gokcek

(57) ABSTRACT

A device has a container containing scented substance. The container has a shroud coupled to an outside surface of the container. Further, the device has a scented piece that is covered by the shroud such that a customer grasps the shroud and pulls the shroud from the scented piece so that the customer can smell a scent emanating from the scented piece.

17 Claims, 2 Drawing Sheets

(56) References Cited

U.S. PATENT DOCUMENTS 5,566,693 A * 10/1996 Gunderman ..... A45D 40/0087 206/823
5,918,608 A * 7/1999 Renna ..... G09F 5/04 206/823
5,960,947 A * 10/1999 Dimelis ..... B65D 23/14 206/730
6,024,386 A * 2/2000 Spector ..... B42D 15/04 239/57
6,047,992 A * 4/2000 Hampton ..... B65D 51/245 206/432
6,444,956 B1 * 9/2002 Witcher ..... F21V 33/00 219/386
6,472,034 B1 * 10/2002 Bourdelais ..... G03C 11/14 430/11
6,746,743 B2 * 6/2004 Knoerzer ..... B32B 7/06 428/34.1
7,004,313 B2 * 2/2006 Mitchell ..... B65D 83/0805 206/812
7,140,135 B2 * 11/2006 Irvine ..... B65D 23/14 428/40.1
7,594,594 B2 * 9/2009 Troost ..... C11D 3/0015 222/145.5
7,686,513 B2 * 3/2010 Knoerzer ..... B65D 75/26 383/111
7,798,320 B2 * 9/2010 Pham ..... B65D 65/42 229/87.13
7,866,507 B2 * 1/2011 Sawin ..... B65D 75/545 222/105
7,967,510 B2 * 6/2011 Martuch ..... B65D 75/5833 229/87.08
8,012,554 B2 * 9/2011 Shelley ..... B65D 81/28 206/524.4
8,048,363 B2 * 11/2011 Schlaupitz ..... G09F 3/04 428/905
8,114,451 B2 * 2/2012 Sierra-Gomez .... B65D 75/5838 383/203
8,408,792 B2 * 4/2013 Cole ..... B65D 77/206 383/203
9,144,621 B1 * 9/2015 Finlay ..... A61L 2/00
9,554,636 B1 * 1/2017 Piscopo ..... A45D 40/04
9,630,761 B2 * 4/2017 Willey ..... B65D 75/5833
9,708,104 B2 * 7/2017 Lyzenga ..... B65D 75/5838
9,896,227 B2 * 2/2018 Nowzari ..... B65D 23/14
9,968,209 B2 * 5/2018 Maranon ..... A47F 7/286
11,225,355 B2 * 1/2022 Huffer ..... B65D 17/502
11,386,811 B2 * 7/2022 Bartlein ..... B65D 23/14
11,410,577 B1 * 8/2022 Powhida ..... G09F 3/10
11,623,805 B2 * 4/2023 Huffer ..... B65D 75/5838 206/484
2001/0003565 A1 * 6/2001 McOsker ..... A45D 40/00 401/132
2001/0027958 A1 * 10/2001 Short ..... A45D 34/00 206/581
2002/0006455 A1 * 1/2002 Levine ..... G09B 19/0092 426/534
2003/0056410 A1 * 3/2003 Witkowski ..... G09F 3/0288 40/310
2003/0213724 A1 * 11/2003 Dobler ..... A61K 8/02 206/1.9
2004/0065748 A1 * 4/2004 Sada ..... A61L 9/042 239/34
2004/0226904 A1 * 11/2004 Schroeder ..... B65D 21/0231 206/499
2004/0238381 A1 * 12/2004 Rademaker ..... B65D 21/0205 206/216
2005/0061710 A1 * 3/2005 Dobler ..... A61L 9/12 206/730
2006/0110080 A1 * 5/2006 Thomas ..... B65D 33/2541 206/524.1
2006/0291756 A1 * 12/2006 Thomas ..... B65D 33/2525 206/524.4
2007/0148293 A1 * 6/2007 Lindsay ..... B65D 5/42 426/112
2008/0056959 A1 * 3/2008 Cuthbert ..... A61L 9/145 422/123
2008/0116213 A1 * 5/2008 Schlaupitz ..... G09F 3/04 283/67
2008/0230424 A1 * 9/2008 Chawla ..... B65D 1/0223 206/459.5
2008/0299263 A1 * 12/2008 Piotrowski ..... B65D 25/205 426/87
2009/0019741 A1 * 1/2009 Schwartz ..... G09F 23/00 40/312
2009/0039174 A1 * 2/2009 Gaines ..... A61L 9/044 206/229
2009/0173654 A1 * 7/2009 Steenblik ..... G09F 19/12 206/459.5
2009/0258118 A1 * 10/2009 Gillian ..... B65D 17/4012 426/112
2009/0314677 A1 * 12/2009 Teggatz ..... B65D 33/004 383/127
2010/0176214 A1 * 7/2010 Joshi ..... A61L 9/03 239/57
2011/0139646 A1 * 6/2011 Sonnenberg ..... A45D 27/225 53/410
2011/0155606 A1 * 6/2011 McKillip ..... G09F 3/10 206/459.5
2012/0132557 A1 * 5/2012 Nowzari ..... G09F 3/02 206/459.5
2012/0219349 A1 * 8/2012 Toh ..... A45D 34/041 401/209
2012/0315412 A1 * 12/2012 Clayton ..... C09D 7/70 523/400
2013/0043245 A1 * 2/2013 Griffis ..... B65D 41/34 239/34
2013/0199266 A1 * 8/2013 Maranon ..... G09F 5/00 73/23.34
2013/0270144 A1 * 10/2013 Nowzari ..... B65D 77/24 206/459.5
2013/0341325 A1 * 12/2013 Bruna ..... B65D 43/02 83/13
2014/0001071 A1 * 1/2014 Sanders ..... B65D 47/42 222/111
2014/0138278 A1 * 5/2014 Kennedy ..... G06Q 90/00 206/459.5
2014/0262904 A1 * 9/2014 Young ..... B65D 75/28 206/524.2
2014/0332434 A1 * 11/2014 Regas ..... B65D 23/085 206/459.5
2015/0076248 A1 * 3/2015 Grodsky ..... B65D 85/70 239/57
2015/0122818 A1 * 5/2015 Bruna ..... B65D 51/20 220/345.6
2016/0016691 A1 * 1/2016 Gillingwater ..... B65D 25/205 220/608
2016/0100670 A1 * 4/2016 Dobler ..... B65D 75/5855 206/484.2
2016/0107796 A1 * 4/2016 Sibley ..... B65B 7/285 206/459.5
2017/0239382 A1 * 8/2017 Griffis ..... B65D 23/12
2017/0298308 A1 * 10/2017 Labeque ..... B65D 43/22
2019/0023452 A1 * 1/2019 Huffer ..... B23K 26/0846
2019/0075844 A1 * 3/2019 De Lavallaz ..... A24F 23/02
2019/0224359 A1 * 7/2019 Griffis ..... B65D 1/0246
2019/0307640 A1 * 10/2019 Vaughn ..... A61J 1/00
2020/0160756 A1 * 5/2020 Gantt ..... G09F 3/02
2021/0035474 A1 * 2/2021 Bartlein ..... B65D 23/14
2021/0179348 A1 * 6/2021 Langlotz ..... B65F 1/0026

* cited by examiner

SCENT INDICATORS ON CONTAINERS

BACKGROUND

A tanning bed, which is also known as a sun-bed, is a machine that produces an artificial tan by imitating the sun's ultraviolet (UV) radiation. A typical tanning bed emits 95% UVA and only 5% UVB, although new models may only produce only UVA.

You can only use indoor tanning lotions when tanning in a tanning bed. There are major differences between indoor and outdoor tanning. UVA rays in a controlled environment compared to outdoor tanning that consists of both UVA and UVB natural rays in a widely varying environment.

There are thousands of different tanning bed lotions produced by thousands of different vendors and having thousands of different scents. One quality that is attractive to tanners is the scent of the tanning lotion. To smell a tanning bed lotion in a bottle, one must remove the lid, which is unsanitary. Further, there is no way to smell a tanning bed lotion in a packet that is not resealable.

DESCRIPTION OF THE DRAWINGS

The present disclosure can be better understood with reference to the following drawings. The elements in these drawings are not necessarily drawn to scale but are included to clearly illustrate the principles pertaining to this disclosure. Furthermore, like reference numerals designate corresponding parts throughout the several views.

DETAILED DESCRIPTION

The present disclosure is a container that holds scented tanning bed lotion. The container is any type of housing that holds the scented tanning bed lotion. For example, the container may be a pliable packet that is opened by tearing off an edge of the packet. As another example, the container may be a rigid bottle that is opened via a lid. In either scenario, a potential customer of the scented tanning bed lotion may desire to smell the scent of the tanning bed lotion prior to purchase.

In accordance with an embodiment of the present disclosure, the container comprises on its outside surface a pull tab. The pull tab is coupled to the container via an adhesive. Under the pull tab is a scented spot indicative of the scent of the enclosed scented tanning bed lotion. Note that the pull tab may be pulled back exposing the scented spot. Once the customer smells the scented spot, the pull tab may be re-adhered to the container so that the next customer may pull the tab and smell the scent of the scented tanning bed lotion.

Figure 1:
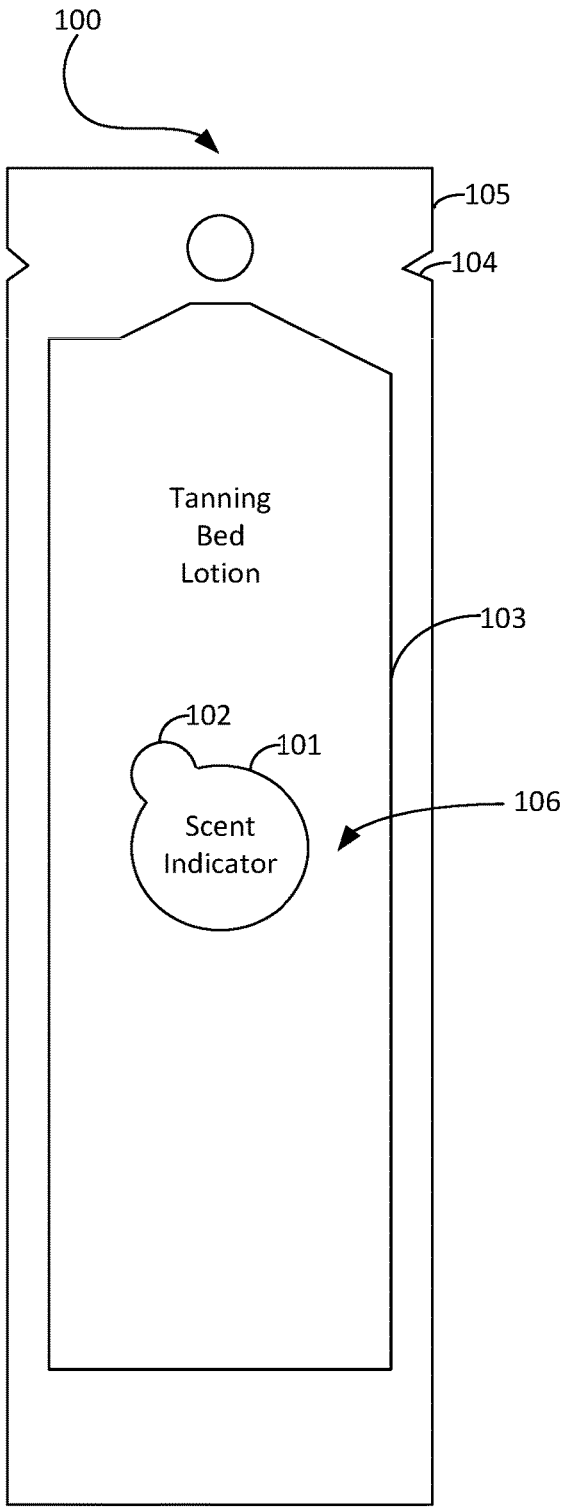
FIG. 1 is an exemplary tanning bed lotion packet in accordance with an embodiment of the present disclosure where a shroud covers a scented spot.

FIG. 1 is scented tanning bed lotion packet 100. The scented tanning bed lotion packet 100 is made of a durable yet flexible material. To use the scented tanning bed lotion (not shown), a customer grasps the flap 105 and tears the top of the packet off at the notch 104.

The scented tanning bed lotion packet 100 comprises a pocket 103. Inside the pocket 103 is the scented tanning bed lotion (not shown). Once the customer tears the top of the packet, the scented tanning bed lotion can be applied to the customer's body for use in a tanning bed.

The scented tanning bed lotion packet 100 further comprises a shroud 101 that covers and protects a scented piece (not shown) that adheres to the outside surface 106 of the scented tanning bed lotion packet 100. The shroud 101 is coupled around a perimeter of the shroud via a glue or epoxy to the outside surface 106 of the scented tanning bed lotion packet 100.

In one embodiment, the shroud 101 comprises a flap 102 that is not coupled to the outside surface 106 of the scented tanning bed lotion packet 100. In this regard, the customer can grasp the flap 102 to pull back the shroud 101 thereby exposing the scented piece. In other embodiments, the shroud 101 does not include the flap 102, and the customer grabs the outside edge of the shroud 101 to remove the shroud 101 from the scented piece.

Figure 2:
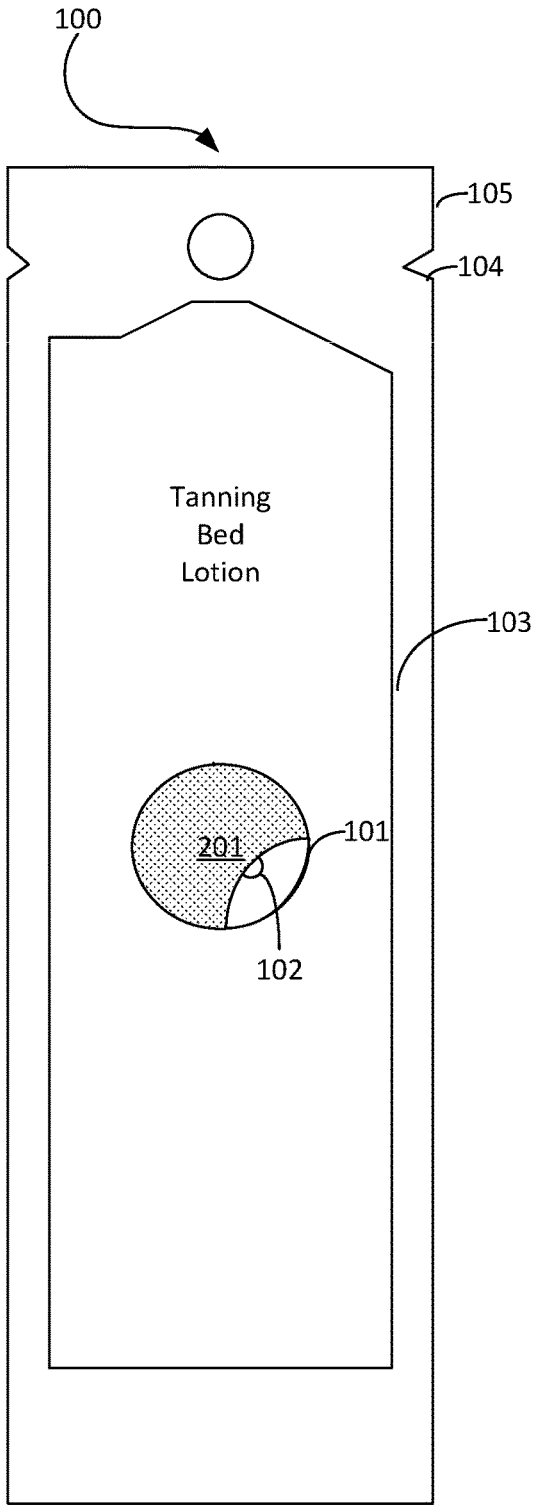
FIG. 2 is the tanning bed lotion packet of FIG. 1 with the shroud removed thereby exposing the scented spot.

FIG. 2 is scented tanning bed lotion packet 100 showing the shroud 101 pulled back from a scented piece 201. In one embodiment, the shroud 101 is pulled back through use of the flap 102. In this regard, the customer pulls back the shroud 101 using the flap 102 exposing the scented piece 201. In other embodiments, the shroud 101 does not include the flap 102, and the customer grabs the outside edge of the shroud 101 to remove the shroud 101 from the scented piece.

When the scented piece 201 is exposed, the customer may smell the scented piece 201. Notably, the scented piece 201 comprises a scent that is identical to the scent of the lotion contained in the pocket 103.

If the customer enjoys the scent of the scented piece, he/she may purchase the scented tanning bed lotion packet 100. To use the scented tanning bed lotion, the customer grasps the flap 105 and tears the top of the scented tanning bed lotion packet 100 at the notch 104. This exposes the scented tanning bed lotion and allows the customer to squeeze the scented tanning bed lotion packet 100 so that the scented tanning bed lotion can be squeezed out of the pocket 103.

Figure 3:
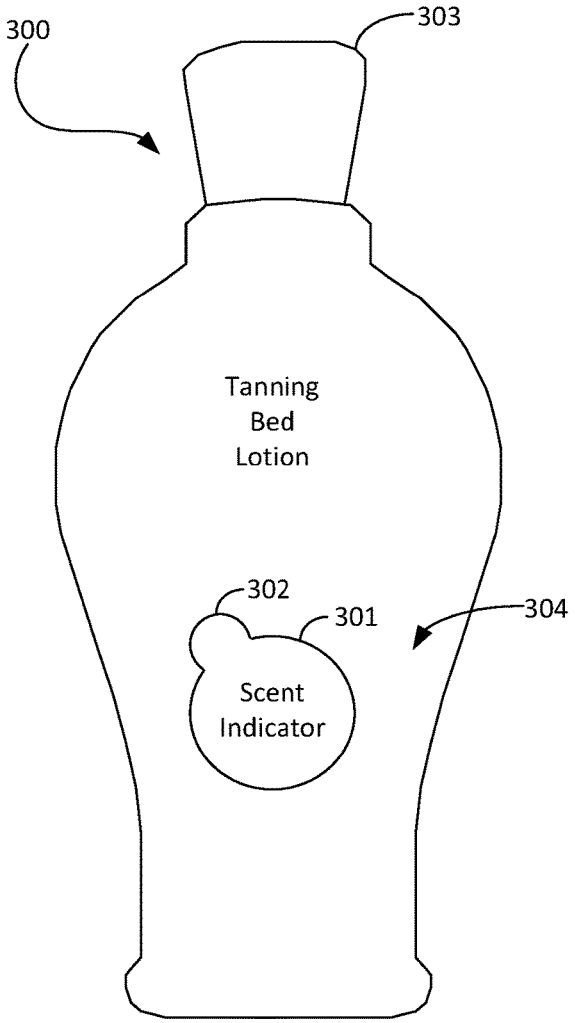
FIG. 3 is an exemplary tanning bed lotion bottle in accordance with an embodiment of the present disclosure where a shroud covers a scented spot.

FIG. 3 is a scented tanning bed lotion bottle 300. The scented tanning bed lotion bottle 300 is made of a durable, rigid material. To use the scented tanning bed lotion (not shown), a customer removes the top 303 of the scented tanning bed lotion bottle 300, squeezes the scented tanning bed lotion bottle 300, and scented tanning bed lotion (not shown) squirts from the mouth (not shown) of the scented tanning bed lotion bottle 300.

The scented tanning bed lotion bottle 300 comprises a cavity (not shown). Inside the cavity is the scented tanning bed lotion (not shown). Once the customer removes the top 303 from the scented tanning bed lotion bottle 300, the scented tanning bed lotion can be applied to the customer's body for use in a tanning bed.

The scented tanning bed lotion bottle 300 further comprises a shroud 301 that covers and protects a scented piece (not shown) that adheres to the outside surface 304 of the scented tanning bed lotion bottle 300. The shroud 301 is coupled around a perimeter of the shroud via a glue or epoxy to the outside surface 304 of the scented tanning bed lotion bottle 300.

In one embodiment, the shroud 301 comprises a flap 302 that is not coupled to the outside surface 304 of the scented tanning bed lotion bottle 300. In this regard, the customer can grasp the flap 302 to pull back the shroud 301 thereby exposing the scented piece. In other embodiments, the shroud 301 does not include the flap 302, and the customer grabs the outside edge of the shroud 301 to remove the shroud 301 from the scented piece.

Figure 4:
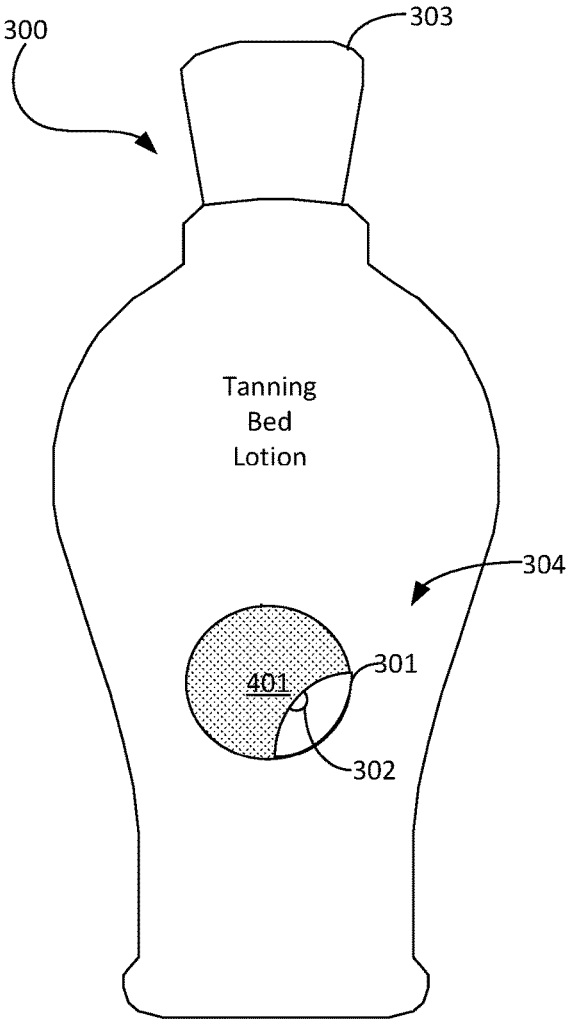
FIG. 4 is the tanning bed lotion bottle of FIG. 3 with the shroud removed thereby exposing the scented spot.

FIG. 4 is scented tanning bed lotion bottle 300 showing the shroud 301 pulled back from a scented piece 401. In one embodiment, the shroud 301 is pulled back from the scented piece 401 through use of the flap 302. In this regard, the customer pulls back the shroud 301 using the flap 302 exposing the scented piece 401. In other embodiments, the shroud 301 does not include the flap 302, and the customer grabs the outside edge of the shroud 301 to remove the shroud 301 from the scented piece 401.

When the scented piece 401 is exposed, the customer may smell the scented piece 401. Notably, the scented piece 401 exhibits a scent that is identical to the scent of the scented tanning bed lotion contained in the cavity of the scented tanning bed lotion bottle 300.

If the customer enjoys the scent of the scented piece 401, he/she may purchase the scented tanning bed lotion bottle 300. To use the scented tanning bed lotion, the customer grasps the body 306 of the scented tanning bed lotion bottle 300 and squeezes. When the customer squeezes the scented tanning bed lotion bottle 300, scented tanning bed lotion squirts out from the scented tanning lotion bottle 300.

Note that the present disclosure describes a scented piece covered by a shroud on a tanning bed lotion packet and bottle. However, the present disclosure is not limited to tanning bed location packets and bottles. In this regard, the present disclosure relates to any type of container that contains a liquid or a powder that has a scent.

For example, a scented piece having a shroud may be placed on containers containing lotions, petroleum jellies, and the like. Further, a scented piece having a shroud may be placed on containers containing outdoor suntan lotion bottles, deodorants, shampoos, conditioners, cleaning supplies, detergents, softeners, wipes, and sheets, e.g., dryer sheets.

What we claim is:

1. A device, comprising:

a container containing a scented substance;

a shroud adhered to an outside surface of the container, the shroud substantially circular and having a substantially circular flap that is contiguous with and extends from the shroud; and a scented piece including a scented spot underneath the shroud and the substantially circular flap, the scented piece adhered to the outside surface of the container and covered by the shroud and the substantially circular flap is grasped and pulled from the scented piece so that a scent emanates from the scented piece and the scent of the scented piece is identical to the scent of the scented substance, wherein the substantially circular flap and the shroud combined have a greater diameter than the scented piece and wherein the substantially circular flap is re-adhered to the container after the substantially circular flap is pulled from the scented piece.

2. The device of claim 1, wherein the container is a packet.

3. The device of claim 1, wherein the container is a bottle.

4. The device of claim 1, wherein the substance is a powder.

5. The device of claim 1, wherein the substance is a liquid.

6. The device of claim 1, wherein the substance is lotion.

7. The device of claim 1, wherein the substance is petroleum jelly.

8. The device of claim 1, wherein the substance is outdoor suntan lotion.

9. The device of claim 1, wherein the substance is deodorant.

10. The device of claim 1, wherein the substance is shampoo.

11. The device of claim 1, wherein the substance is conditioner.

12. The device of claim 1, wherein the substance is a cleaning supply.

13. The device of claim 1, wherein the substance is detergent.

14. The device of claim 1, wherein the substance is a softener.

15. The device of claim 1, wherein the substance is a wipe.

16. The device of claim 1, wherein the substance is a dryer sheet.

17. The device of claim 1, wherein the scented piece is located on a side of a body of the container.

* * * * *